US010384363B2

(12) United States Patent
Brown

(10) Patent No.: US 10,384,363 B2
(45) Date of Patent: Aug. 20, 2019

(54) DOUBLE BLADE MEAT SLICER

(76) Inventor: Dennis R. Brown, Warrensburg, MO (US)

( * ) Notice: Subject to any disclaimer, the term of this patent is extended or adjusted under 35 U.S.C. 154(b) by 2891 days.

(21) Appl. No.: 12/694,164

(22) Filed: Jan. 26, 2010

(65) Prior Publication Data

US 2011/0023682 A1 Feb. 3, 2011

Related U.S. Application Data

(60) Provisional application No. 61/147,388, filed on Jan. 26, 2009.

(51) Int. Cl.
*B26D 3/11* (2006.01)
*B26D 3/28* (2006.01)

(52) U.S. Cl.
CPC ..... *B26D 3/11* (2013.01); *B26D 3/28* (2013.01); *Y10T 83/0267* (2015.04)

(58) Field of Classification Search
CPC ... Y10T 83/0267; Y10T 83/7755; B26D 3/11; B26D 3/28
USPC ..... 83/483, 488, 870, 932; 82/56, 98; 426/518
See application file for complete search history.

(56) References Cited

U.S. PATENT DOCUMENTS 3,951,054 A 4/1976 Frentzel
4,050,370 A 9/1977 Schmidt
4,170,174 A 10/1979 Ditty
4,217,799 A 8/1980 Faris
4,287,820 A * 9/1981 Urban ..... 99/538
4,332,190 A 6/1982 Mart
4,386,560 A 6/1983 Ditty
4,412,483 A 11/1983 Hoegh
4,441,411 A 4/1984 Mullins, Jr.
4,821,635 A 4/1989 Logan, Jr.
5,030,472 A 7/1991 Logan, Jr.
5,251,543 A 10/1993 Brothers
RE35,374 E 11/1996 Logan, Jr.
(Continued)

FOREIGN PATENT DOCUMENTS

JP 2002-321119 * 5/2002 ..... B23D 21/00

OTHER PUBLICATIONS

Spirocut Equiopment Co. The Combination of Easy Operation and Precise, Continuous Slicing Adds Up to a Quick Payback. Website, http://www.spirocut.com, Texas, USA.

*Primary Examiner* — Jason Daniel Prone
*Assistant Examiner* — Samuel A Davies
(74) *Attorney, Agent, or Firm* — Arthur K. Shaffer; Intellectualy Property Center, LLC

(57) ABSTRACT

The present invention provides a double bladed spiral slicer including a first and second blade assemblies on a surface, each assembly having a mechanical output and operable to rotate about a vertical axis. A meat rotation assembly, having a headstock and tailstock, is adapted for rotation of a received meat. A processor and controller in communication with the blade assemblies operate to direct the blade assemblies to form a spiral slice on the surface of the meat. The meat product is engaged to the meat rotation assembly where the upper position of the meat product is determined. The meat product is rotated about a vertical axis and the blade assemblies operate by simultaneously reciprocally engaging the meat product and moving vertically from the central position of the meat product.

7 Claims, 5 Drawing Sheets

(56) References Cited

U.S. PATENT DOCUMENTS

| | | | | |
|---|---|---|---|---|
| 6,096,360 | A | 8/2000 | Dieso | |
| 6,234,073 | B1 | 5/2001 | Dieso | |
| 6,484,627 | B1 | 11/2002 | Peter | |
| 6,655,884 | B2 * | 12/2003 | Ferrari et al. | 409/212 |
| 6,758,133 | B2 | 7/2004 | Weber | |
| 2003/0070525 | A1 * | 4/2003 | Barnhart | 83/932 |
| 2008/0066591 | A1 * | 3/2008 | Yamane et al. | 82/121 |
| 2008/0168860 | A1 * | 7/2008 | Nishi et al. | 74/616 |
| 2008/0245208 | A1 | 10/2008 | Cusick | |

* cited by examiner

DOUBLE BLADE MEAT SLICER

CROSS-REFERENCE TO RELATED APPLICATION

This application claims priority under 35 U.S.C. 119(e) and 37 C.F.R. 1.78(a)(4) based upon U.S. Provisional Application Ser. No. 61/147,388 for DOUBLE KNIFE SPIRAL CUTTER, filed Jan. 26, 2009, the disclosure of which is incorporated herein by reference.

FIELD OF THE INVENTION

This invention relates generally to a meat cutter and more specifically to a dual blade spiral meat cutter to form a spiral slice within a piece of meat such as a ham with a center bone.

BACKGROUND OF THE INVENTION

Several attempts have previously been made regarding a spiral slicer for cutting a piece of meat. Spiral sliced meats have grown in popularity since they were first introduced and many food processing plants now provide spiral sliced meat products. Generally, most spiral slicers form a continuous cut within a piece of meat from one end to the other end. However, these spiral slicers have several disadvantages addressed by the present invention.

SUMMARY OF THE INVENTION

The present invention provides a double bladed spiral slicer including a first blade assembly having a mechanical output fixed to an angularly selectable first cutting blade, said first blade assembly operable to rotate about a first vertical axis, a second blade assembly having a mechanical output fixed to an angularly selectable second cutting blade, said second blade assembly operable to rotate about a second vertical axis, said first and second vertical axis being spaced along a top surface associated with a meat rotation assembly, said meat rotation assembly adapted for rotation of the received meat product and including a tailstock assembly in communication with a headstock assembly and adapted for rotational receipt of said meat product; and a processor and controller in communication with said first and second blade assemblies and operable to simultaneously direct said first blade assembly towards a lower position and said second blade assembly towards an upper position, whereby a spiral slice is formed along the surface of the meat product. The present invention also includes a method for producing a spiral cut on a meat product having a central bone, said method comprising the steps of (a) providing a first blade assembly with a first cutting blade and second blade assembly with a second cutting blade, said first and second blade assemblies mounted in an opposing relationship; (b) engaging said meat product by to a meat rotation assembly including a headstock and a tailstock separated by the meat product; (c) determining an upper position of said meat product; (d) rotating said meat product about a vertical meat axis; (e) operating said blade assemblies in an operational condition by rotating said first blade assembly towards a lower position of said meat product and said second blade assembly towards an upper position of said meat product; and (f) reciprocally engaging said meat product by said first and second cutting blades whereby at least one spiral cut is formed along said meat product from said upper position to said lower position.

DETAILED DESCRIPTION OF THE INVENTION

I. Introduction

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. A Double Bladed Spiral Slicer

Figure 1:
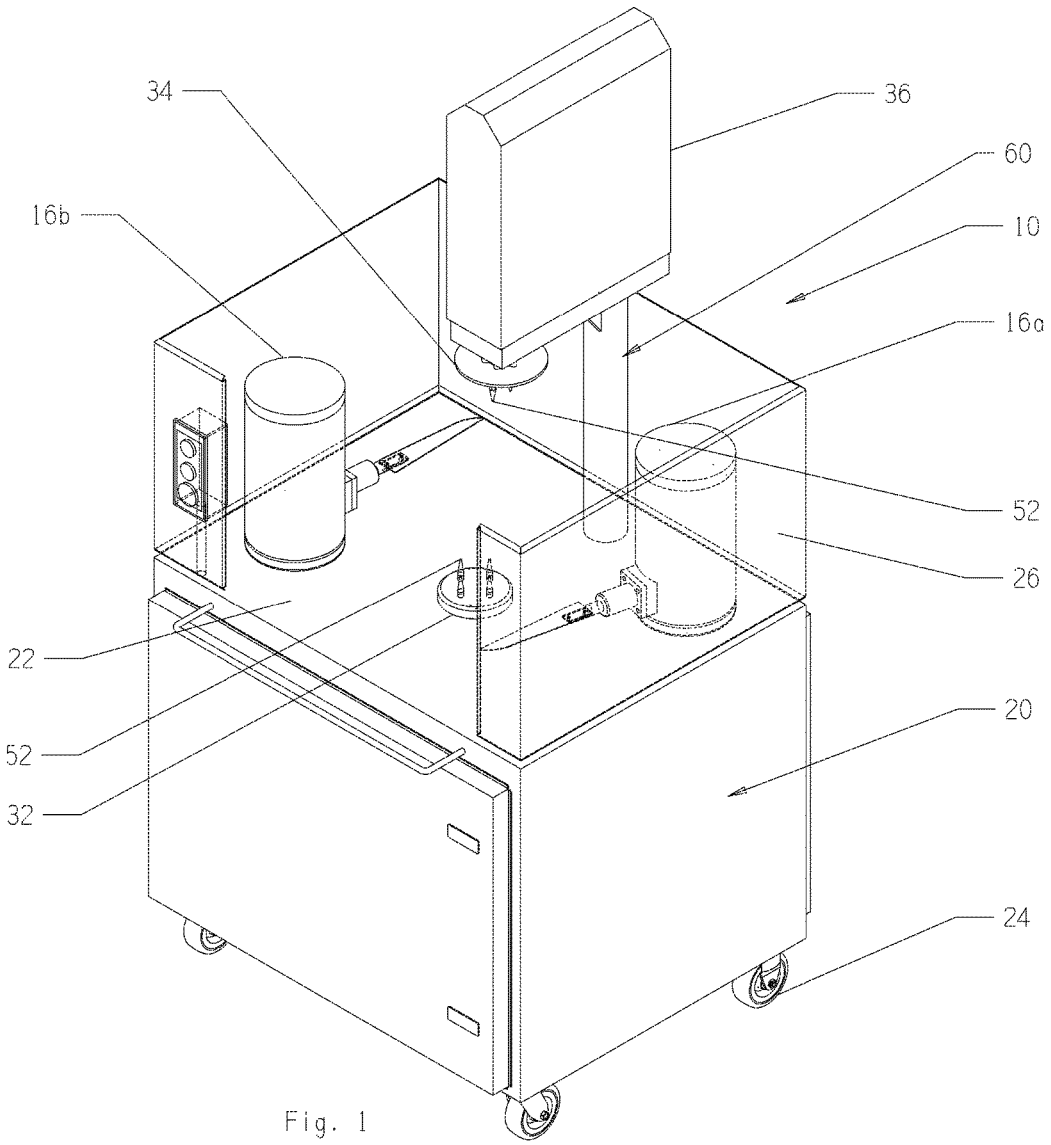
FIG. 1 is a side perspective view of a double bladed spiral slicer adapted for forming a spiral slice along a piece of meat.

The present invention can be used for slicing meat products, where the current invention has implemented additional cutting elements, a new process and additional safety features to provide an improved spiral slicer which prevents injury to workers and expedites the slicing process. Referring to FIG. 1, an embodiment of the present invention, a double bladed spiral slicer, is generally indicated by reference numeral 10. The double bladed spiral slicer 10 is shown associated with a unitary or enclosed cabinet 20 having a top 22 and sides 26, at least one of which is translucent. An enclosure is defined by the top 22 and sides 26. In general, the double bladed spiral slicer 10 includes a meat rotation assembly 30 illustrated in FIG. 2 with a headstock assembly 32 vertically aligned with a tailstock assembly 34 associated with an upper support 36. Plural blade assemblies 16*a*, 16*b* are angularly oriented and in communication with each other. Each blade assembly 16*a*, 16*b* extends from the top 22 of the cabinet 20 and is adapted for engagement with the meat product (not shown) positioned between the headstock assembly 32 and the tailstock assembly 34. Optionally the cabinet 20 may include plural casters or wheels 24 for ready movement of the slicer 10.

The meat product, may include, but is not limited to, a pork product and may include other meat products having a central bone. In operation, the meat product is received by the meat rotation assembly 30 with a plurality of meat receiving devices 52, such as but not limited to prongs, skewers, spikes or needles spaced along a rotational surface 54 associated with the cabinet top 22. Once the meat product is properly positioned on the meat rotation assembly 30, the tailstock assembly 34 is lowered onto the meat product for engagement by the tailstock assembly 34. Upon engagement, the first and second blade assemblies 16*a*, 16*b* move from a resting condition towards an operational condition with knives associated with the blade assemblies 16*a*, 16*b* directed towards the surface of the meat product. In the resting condition both blade assemblies 16*a*, 16*b* are spaced apart from each other and the meat product.

In the operational condition the first blade assembly 16*a* approaches a lower position and the second blade assembly 16*b* approaches an upper position. Once the first and second blade assemblies 16*a*, 16*b* are properly positioned, the meat rotation assembly 30 begins to rotate the meat product with the first and second blade assemblies 16*a*, 16*b* moving reciprocally from an outer orientation towards an inner orientation associated with the meat bone. During the slicing operation, the first blade assembly 16*a* moves from a lower position towards a central position, and the second blade assembly 16*b* moves from the upper position towards the central position. Alternatively, during the slicing operation, the first blade assembly 16*a* in electrical communication with the controller 8 may move from the central position towards the lower position, and the second blade assembly 16*b* in electrical communication with the controller 8 may move from the central position to the upper position. Generally, the lower position is associated with the headstock assembly 32 and the upper position is associated with the tailstock assembly 34, the central position spaced therebetween.

In transition to the operational condition, the first blade assembly 16*a* approaches the lower position and the second blade assembly 16*b* approaches the upper position. Once in position, both the first and second blade assemblies 16*a*, 16*b* move from the outer orientation towards the inner orientation. Generally when both the first and second blade assemblies 16*a*, 16*b* reach the centralized position, at least one spiral slice has been funned axially along the vertically positioned meat bone. After the meat product is sliced, or when otherwise commanded by a user operated control panel, the first and second blade assemblies 16*a*, 16*b* separate from the meat product and rotate towards the resting condition.

As previously mentioned, the cabinet 20 includes a top 22 with a plurality of apertures designed to allow passage of various assemblies therethrough. Generally, the cabinet 20 supports the enclosure and encloses various connections coupled to at least one motor which is operated through plural push buttons conveniently associated with at least one side 26. For example, a rotational surface 54 associated with the headstock assembly 32 is operably connected to the motor for rotating the meat product. In addition, the upper support 36 includes a motorized drive shaft 78 for rotating the tailstock assembly 34. The first and second blade assemblies 16*a*, 16*b* may also be motorized for adjusting and reciprocating cutting blades 18 along the meat product.

Figure 2:
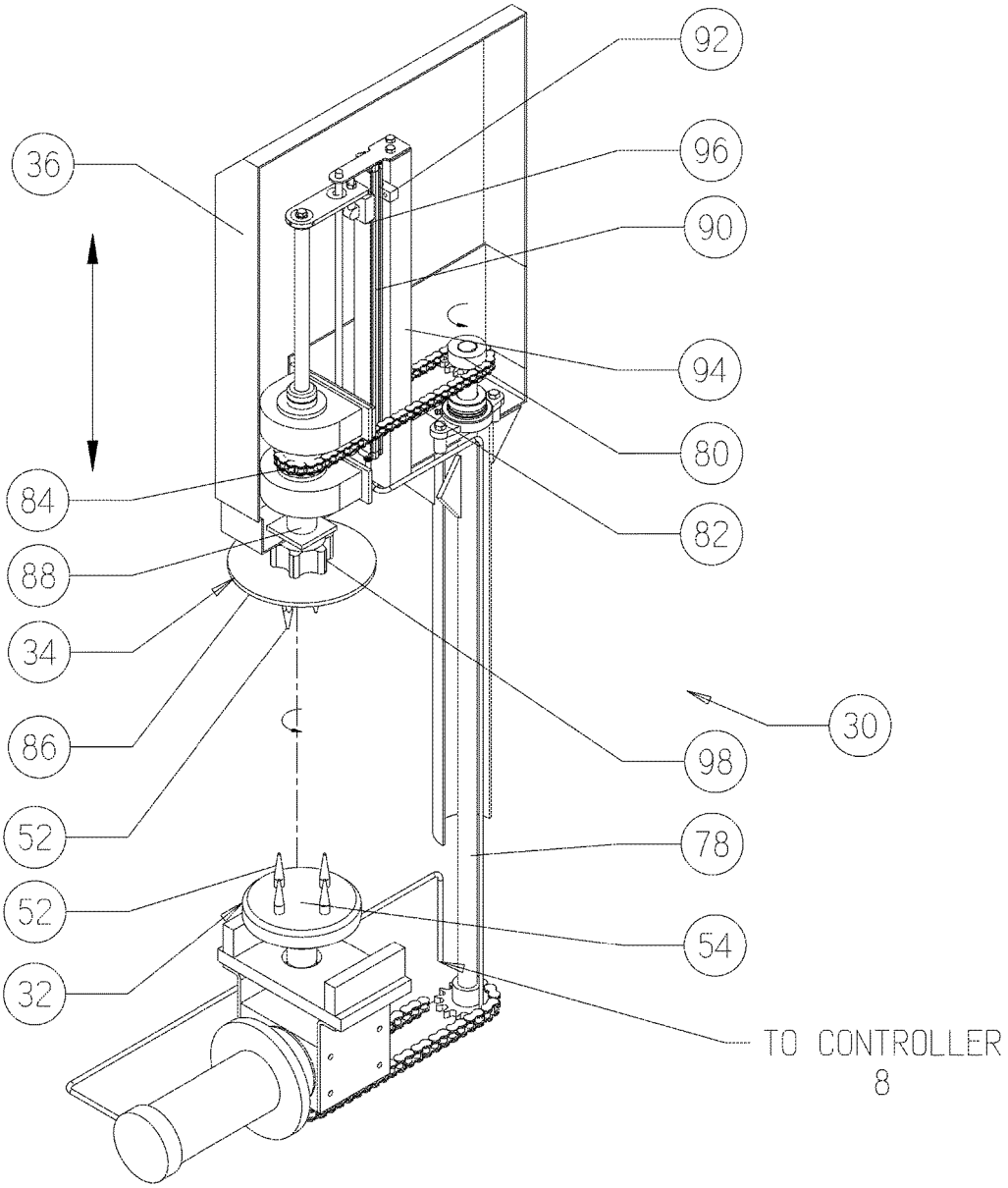
FIG. 2 is a front perspective view of the double bladed spiral slicer taken along line A-A illustrated in FIG. 1.

FIG. 2 illustrates various components associated with the upper support 36, including the tailstock assembly 34 operably connected to the motorized drive shaft 78 which is illustrated as being motorized. Using mechanical linkage such as the depicted chain 32 and gear system, although other mechanical linkages may be utilized, the drive shaft 78 extends vertically towards the upper support 36 through the top 22. The drive shaft 78 rotateably drives the tailstock assembly 34 with, for example, rotational chain and gear linkages which operably connect the drive shaft 78 to the tailstock assembly 34.

As depicted in FIG. 2, a first gear 80 is in mechanical communication with a second gear 84 through a chain 82 rotating thereabout. The first gear 80 is associated with the drive shaft 78 and the second gear 84 is generally associated with the tailstock assembly 34. The tailstock assembly 34 extends from the upper support 36 at the second gear 84 and terminates at a meat receiving device 52 associated with a rotatable wheel 86 operably connected to a tail drive 88 in communication with the second gear 84 via a star fastener 98. As the drive shah 78 rotates, the first gear 80 in communication with the second gear 84, rotatably operates the tail drive 88. The rotation of the tail drive 88 rotates the received meat product for slicing by the cutting blades 18.

Generally, the double bladed spiral slicer 10 provides a rotational axis about which the meat product is sliced, the rotational axis extending between the headstock 32 and tailstock assemblies 34. In addition, as further illustrated in FIG. 2, an upper transducer 92 is provided, in electric communication with the controller 8, the upper transducer 92 being adapted for cutting of the meat product by the cutting blades 18. The upper transducer 92 is generally responsive to the vertical position of the tailstock assembly 34.

During a slicing operation, the blade assemblies 16*a*, 16*b* use the upper, lower and central positions associated with the received meat product in order to position the cutting blades 18 associated with the blade assemblies 16*a*, 16*b*. The lower position generally corresponds to the headstock assembly 32. However, the upper position is generally associated with the tailstock assembly 34 which depends at least in part on the vertical height of the received meat product. The central position, likewise, depends at least in part on the vertical height of the received meat product and therefore, in order to properly position the blade assemblies 16*a*, 16*b*, the upper transducer 90 is generally responsive to the vertical position of the tailstock assembly 34 when positioned on the meat product.

Once the meat product is positioned on the headstock assembly 32, the tailstock assembly 34 is lowered towards the meat product top. As the tailstock assembly 34 descends, an electromagnetic source associated with the surface of the transducer 96 slidably moves along transducer rod 90 in relation to the tailstock assembly 34. Once the tailstock assembly 34 is properly positioned, the relative vertical height of the received meat product is determined, establishing the upper and central positions. After determining the upper, central and lower positions, the first and second blade assemblies 16*a*, 16*b* may be properly positioned for slicing the meat product. Although the transducer 96 is illustrated in association with the transducer upper support 94 between the first and second gears 80, 84 it may be positioned at various locations in association with the transducer upper support 94. Generally, the processor in electric communication with the upper transducer 92 through a suitable electronic circuitry, calculates the position of the tailstock assembly 34 for engaging the meat product.

Figure 3:
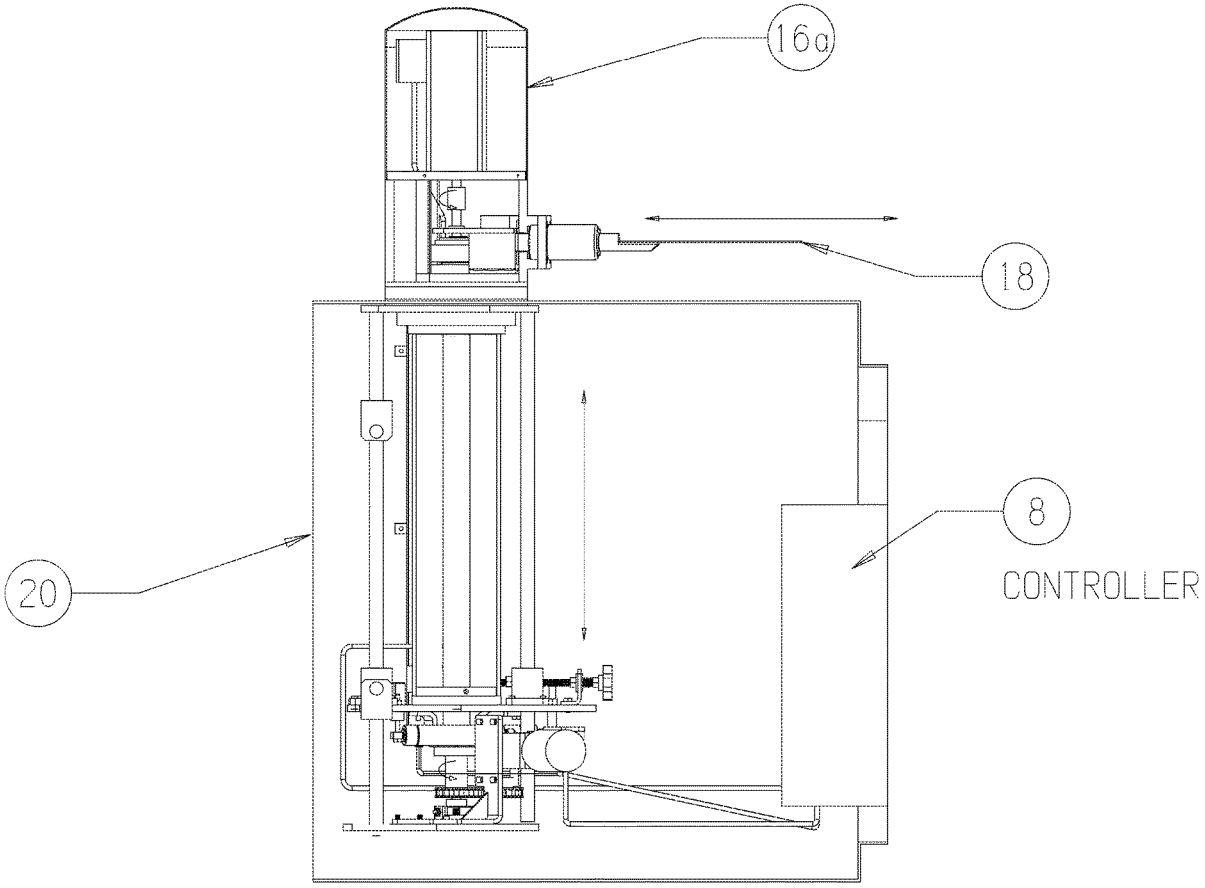
FIG. 3 is a side perspective view of a blade assembly supported by an enclosure.
Figure 4:
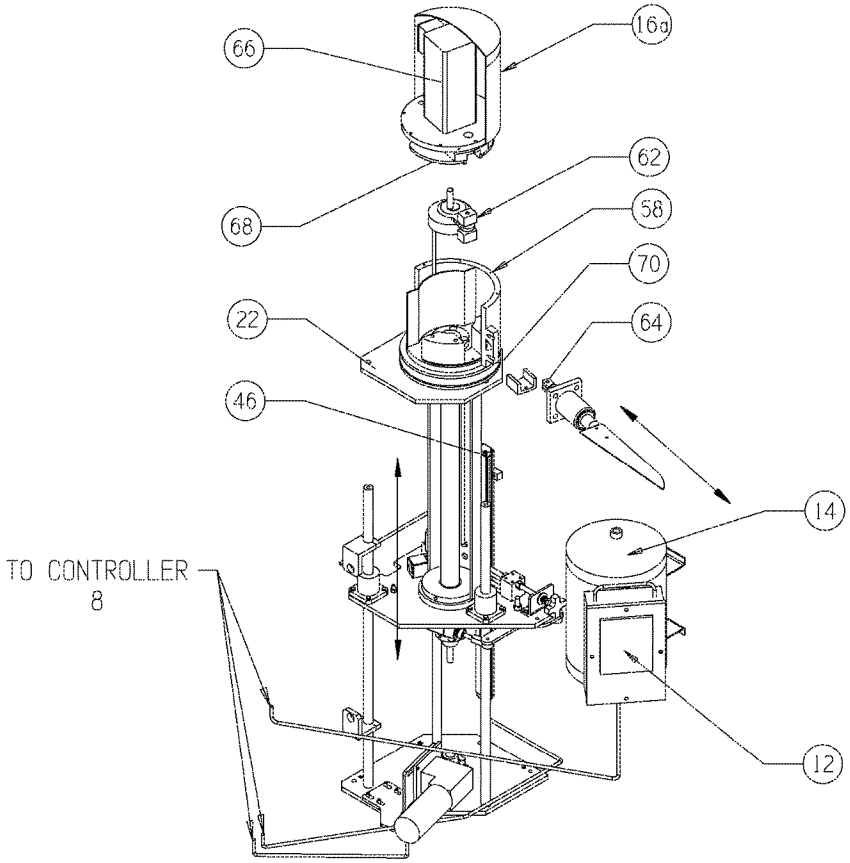
FIG. 4 is a semi-exploded schematic drawing of a blade head assembly.
Figure 5:
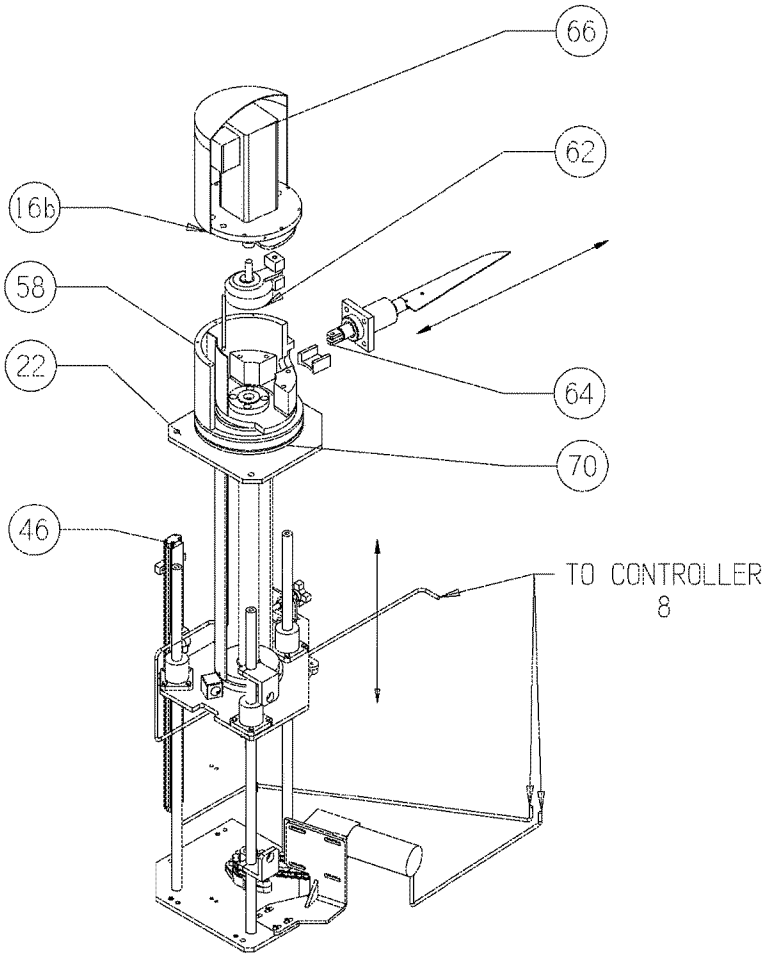

As illustrated in FIG. 3 the blade assembly 16*a*, 16*b* generally extends through the enclosure 20, with the supporting and operable structures positioned therein. FIGS. 4 and 5 illustrated a semi-exploded sectional perspective view of the first and second blade assemblies 16*a*, 16*b*. The first blade assembly 16*a* is generally associated with a cylindrical housing 58 supported by the cabinet top 22. The first blade assembly 16*a* is illustrated in communication with a vertically mounted servo motor 66 and is operably connected to a lower actuator 62. The lower actuator 62 is operably connected to a linkage member 64, providing reciprocal movement to the cutting blade 18. In one embodiment, the blade assemblies 16*a*, 16*b* move from the resting condition to the operational condition by operating the servo motor 66 coupled through a rotational cam guide 68 to the lower actuator 62. As the lower actuator 62 angularly moves the linkage member 64, the blade assemblies 16*a*, 16*b* are biased inwardly, from the resting condition towards the operational condition. A slotted guide 70, guides the angular movement of the linkage 64. While the slotted guide 70 may be configured to provide up to 360° of rotation, preferably the slotted guide 70 rotates the linkage less than 180°. The servo motor 66 is operated by the controller 8 in communication with the processor and is located generally within the enclosure 20. In addition, a cylindrical sleeve 60 is provided which allows passage between the enclosure 20 and the upper support 36.

Having thus described the invention, what is claimed as new and desired to be secured by Letters Patent is as follows:

1. A device for producing a spiral cut on a single non-symmetrical meat product having a meat surface and a central bone, said device comprising:

a first blade assembly having a mechanical output fixed to an angularly selectable first cutting blade, said first blade assembly operable to rotate about a first vertical axis;

a second blade assembly having a mechanical output fixed to an angularly selectable second cutting blade, said second blade assembly operable to rotate about a second vertical axis, said first and second vertical axis being spaced along a top surface associated with a meat rotation assembly;

said meat rotation assembly adapted for rotation of the received meat product and including a tailstock assembly in communication with a headstock assembly and adapted for rotational receipt of said meat product; and a processor and controller in communication with said first and second blade assemblies and operable to simultaneously reciprocally engage the meat product in at least two positions with said first blade assembly at a lower spiral position and said second blade assembly at an upper spiral position, whereby a spiral slice is formed from the simultaneous operation of both said first and second blade assemblies slicing in opposing directions from the meat surface of the meat product to the meat bone.

2. The device according to claim 1 wherein said blade assemblies move reciprocally from an outer orientation towards an inner orientation associated with the central bone.

3. The device according to claim 1 wherein said top surface is associated with an enclosure having a side extending along the periphery of the top surface and at least a portion of which is translucent.

4. The device according to claim 3 comprising plural casters fixed along a bottom of said cabinet and adapted for selectively positioning said enclosure for rotational receipt of said meat product.

5. The device according to claim 1 wherein said headstock is vertically aligned with said tailstock along a vertical meat axis extending between said tailstock and said headstock through said meat product.

6. The device according to claim 1 wherein said first and second blade assemblies operably move from a resting condition towards an operational condition with the first blade assembly approaching a lower position and the second blade assembly approaching an upper position.

7. The device according to claim 6 wherein said controller, in electric communication with an upper transducer, selectively positions the second blade assembly towards the upper position.

* * * * *